US009051939B2

(12) United States Patent
Chang et al.

(10) Patent No.: US 9,051,939 B2
(45) Date of Patent: Jun. 9, 2015

(54) RECIRCULATION FAN AND FAN ASSEMBLY THEREOF

(75) Inventors: Shun-Chen Chang, Taoyuan Hsien (TW); Wen-Bin Liu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 584 days.

(21) Appl. No.: 13/479,906

(22) Filed: May 24, 2012

(65) Prior Publication Data

US 2013/0149104 A1 Jun. 13, 2013

(30) Foreign Application Priority Data

Dec. 9, 2011 (TW) ..... 100145576 A

(51) Int. Cl.
*F04D 25/08* (2006.01)
*F04D 25/12* (2006.01)
*F04D 29/54* (2006.01)

(52) U.S. Cl.
CPC ..... *F04D 25/082* (2013.01); *F04D 25/12* (2013.01); *F04D 29/541* (2013.01)

(58) Field of Classification Search
CPC ..... F04D 13/024; F04D 13/027; F04D 13/12; F04D 19/007; F04D 19/026; F04D 25/026; F04D 25/082; F04D 25/12; F04D 29/048; F04D 29/058; F04D 29/329; F04D 29/54; F04D 29/541; F05B 2240/51; F05B 2240/511; F05B 2240/515; F05B 2260/302; F05B 2260/404; F05B 2260/4041; F05B 2260/903
USPC ..... 416/120, 124, 125, 198 R, 247 R; 415/198.1, 199.4, 208.1, 211.2
See application file for complete search history.

(56) References Cited

U.S. PATENT DOCUMENTS

| | | | | |
|---|---|---|---|---|
| 7,391,140 | B2 * | 6/2008 | Horng et al. | 310/90 |
| 7,438,120 | B2 * | 10/2008 | Hong et al. | 165/80.4 |
| 7,780,422 | B2 * | 8/2010 | Berroth | 417/420 |
| 8,721,302 | B2 | 5/2014 | Chang et al. | |
| 2002/0090308 | A1 | 7/2002 | Cheng | |
| 2007/0031248 | A1 * | 2/2007 | Hsu et al. | 415/191 |
| 2009/0074596 | A1 | 3/2009 | Qin | |
| 2011/0223042 | A1 * | 9/2011 | Chang et al. | 417/313 |

FOREIGN PATENT DOCUMENTS

| | | |
|---|---|---|
| TW | M410191 | 8/2011 |
| TW | 201131078 | 9/2011 |

* cited by examiner

*Primary Examiner* — Dwayne J White
*Assistant Examiner* — Adam W Brown
(74) *Attorney, Agent, or Firm* — Kirton McConkie; Evan R. Witt

(57) ABSTRACT

A recirculation fan includes a casing, a covering member, and a fan assembly. The casing has a base. The covering member is coupled with the casing to define an accommodation space. The fan assembly is disposed within the accommodation space, and includes a first impeller, a second impeller, a motor, and a plurality of magnetic elements. The second impeller is located beside the first impeller. The motor is fixed on the base of the casing and connected with the first impeller for driving rotation of the first impeller. The magnetic elements are arranged between the first impeller and the second impeller. A wind force generated by the first impeller and a magnetic torque resulted from a magnetic vortex of the magnetic elements cause contactless rotation of the second impeller.

19 Claims, 6 Drawing Sheets

RECIRCULATION FAN AND FAN ASSEMBLY THEREOF

FIELD OF THE INVENTION

The present invention relates to a recirculation fan, and more particularly to a recirculation fan driven by a composite motive force. The present invention also provides a fan assembly of the recirculation fan.

BACKGROUND OF THE INVENTION

In recent years, with increasing environmental consciousness, more and more products are designed in views of energy conservation and carbon reduction policy. Consequently, government organizations, enterprises, schools or families pay much attention to the reduction of the frequency and time period of using the air conditioners. For maintaining air circulation and increasing space utilization, a variety of new fans and recirculation fans are introduced into the market.

For most fans, a motor is employed to drive rotation of the fan blades and produce airflow. Consequently, the convection within the indoor construction site will be enhanced and the indoor temperature can be controlled. The mainstream of the indoor recirculation fan is for example a hanging-type fan or a top-embedded fan.

However, due to the spatial and position limitation, the performance of such recirculation fan is usually unsatisfied. In addition, if the amount of the airflow required for indoor convection is increased, the fan should have a longer and larger fan blade. Correspondingly, a large-power and large-size motor is used to provide sufficient torque to rotate the fan. For complying with the large-size motor, the volume of the fan should be largely increased. Under this circumstance, the regions unable to inhale or exhale the airflow will be increased, and the space utilization is deteriorated. In addition, since the overall power consumption is largely increased, it is difficult to achieve the energy conservation and carbon reduction purpose. In other words, the process of deploying the conventional recirculation fan is complicated and the layout cost is increased.

SUMMARY OF THE INVENTION

As previously described, if the amount of the airflow required for indoor convection is increased, the conventional fan should have a longer and larger fan blade and a large-power and large-size motor is necessary. Under this circumstance, the regions unable to inhale or exhale the airflow will be increased, and the space utilization is deteriorated. One object of the present invention is to provide a recirculation fan and a fan assembly of the recirculation fan for eliminating the drawbacks encountered from the prior art.

It is another object of the present invention to provide a recirculation fan and a fan assembly of the recirculation fan, in which the recirculation fan is driven by a composite motive force, so that a small-size impeller and a small-size motor may be employed. Consequently, the overall volume and power consumption of the recirculation fan are reduced, the space layout is simplified, and the cost is reduced.

In accordance with an aspect of the present invention, there is provided a recirculation fan. The recirculation fan includes a casing, a covering member, and a fan assembly. The casing has a base. The covering member is coupled with the casing to define an accommodation space. The fan assembly is disposed within the accommodation space, and includes a first impeller, a second impeller, a motor, and a plurality of magnetic elements. The second impeller is located beside the first impeller. The motor is fixed on the base of the casing and connected with the first impeller for driving rotation of the first impeller. The magnetic elements are arranged between the first impeller and the second impeller. A wind force generated by the first impeller and a magnetic torque resulted from a magnetic vortex of the magnetic elements cause contactless rotation of the second impeller.

In accordance with another aspect of the present invention, there is provided a fan assembly. The fan assembly includes a first impeller, a second impeller, a motor, and a plurality of magnetic elements. The second impeller is located beside the first impeller. The motor is connected with the first impeller for driving rotation of the first impeller. The magnetic elements are arranged between the first impeller and the second impeller. A wind force generated by the first impeller and a magnetic torque resulted from a magnetic vortex of the magnetic elements cause contactless rotation of the second impeller.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
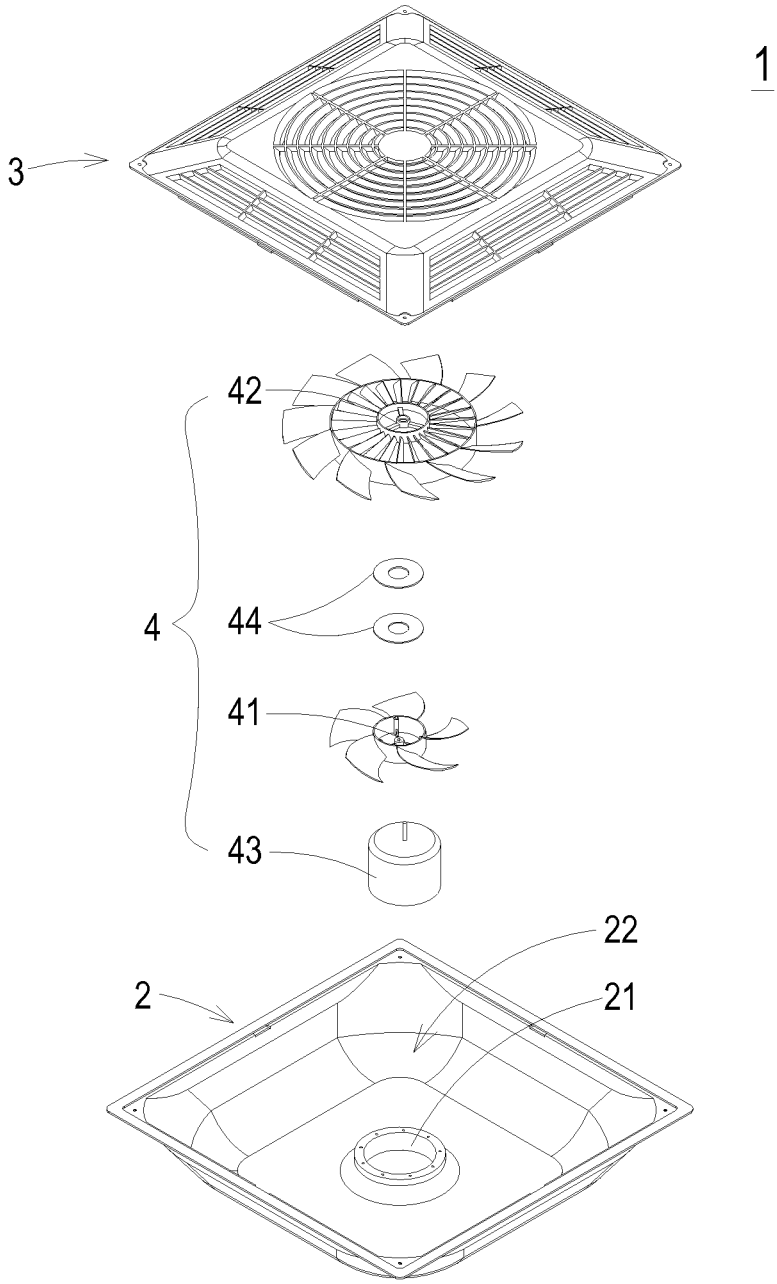
FIG. 1 is a schematic exploded view illustrating a recirculation fan according to an embodiment of the present invention.

FIG. 1 is a schematic exploded view illustrating a recirculation fan according to an embodiment of the present invention. The recirculation fan 1 is used to increase the convection and control the environmental temperature. As shown in FIG. 1, the recirculation fan 1 comprises a casing 2, a covering member 3, and a fan assembly 4. The casing 2 has a base 21. The base 21 has a cylindrical, cubic or rectangular space. The base 21 is integrally formed with the casing 2. Alternatively, the base 21 may be fixed on the casing 2 by an adhering means, a screwing means or an engaging means. After the covering member 3 is combined with the casing 2, an accommodation space 22 is defined to accommodate some components of the recirculation fan 1 and provide a space for operating the fan assembly 4.

The fan assembly 4 is disposed within the accommodation space 22. In addition, the fan assembly 4 comprises a first impeller 41, a second impeller 42, a motor 43, and a plurality of magnetic elements 44. The second impeller 42 is located beside the first impeller 41. The motor 43 is fixed on the base 21 of the casing 2 by an adhering means, a screwing means or an engaging means. Preferably, the motor 43 is fixed on the base 21 of the casing 2 by a screwing means in order to reduce vibration and noise. In addition, the motor 43 is connected with the first impeller 41 for driving rotation of the first impeller 41. The dimension of the motor 43 is preferably fitted to the space of the base 21. The magnetic elements 44 are permanent magnets or magnetic conductors (e.g. iron, cobalt and nickel magnetic conductors). The magnetic elements 44 are disposed on the first impeller 41 and the second impeller 42. Moreover, at least one of the magnetic elements 44 is a permanent magnet, and the other magnetic elements 44 are magnetic conductors or permanent magnets. Due to magnetic change and magnetic induction, the magnetic elements 44 generate a magnetic vortex. The wind force generated by the running first impeller 41 and the magnetic torque resulted from the magnetic vortex of the magnetic elements 44 will cause contactless rotation of the second impeller 42. Since the second impeller 42 is driven by the composite non-contact force, a small-size impeller 41 and a small-size motor 43 may be employed. Consequently, the overall volume and power consumption of the recirculation fan 1 are reduced, the power-saving efficacy is enhanced, the space utilization is enhanced, and the cost is reduced.

Figure 2A:
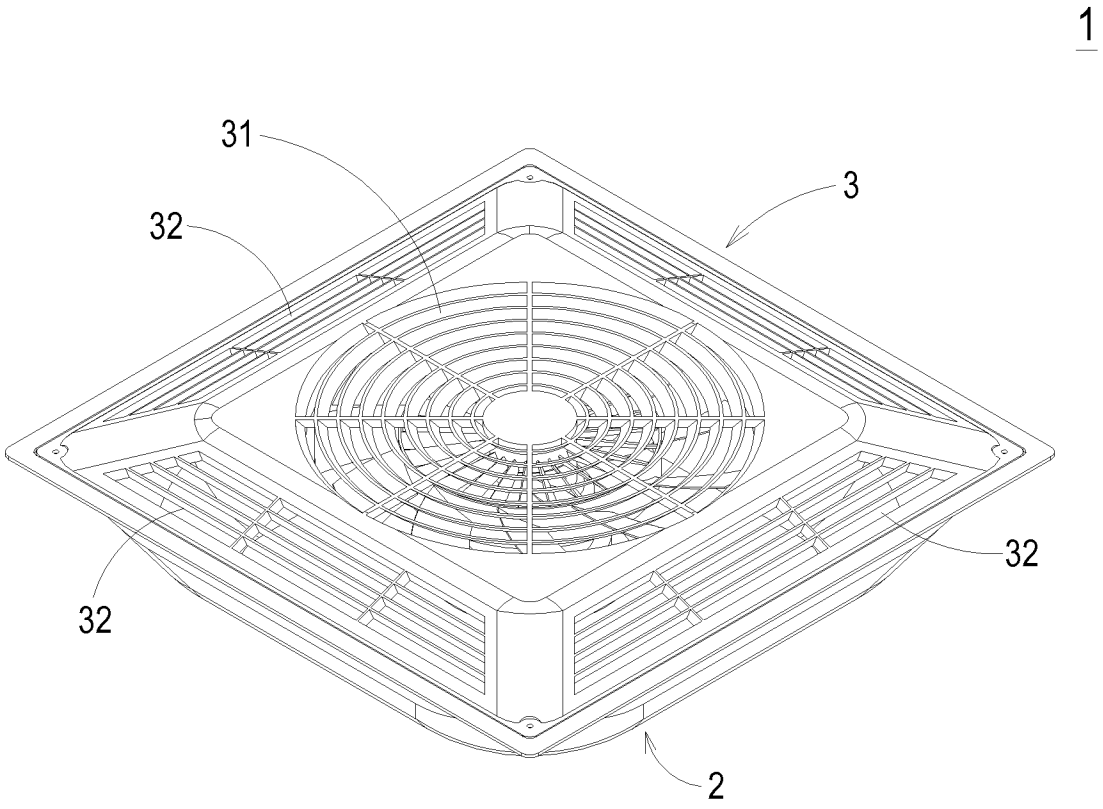
FIG. 2A is a schematic top view illustrating the assembled recirculation fan of FIG. 1.
Figure 2B:
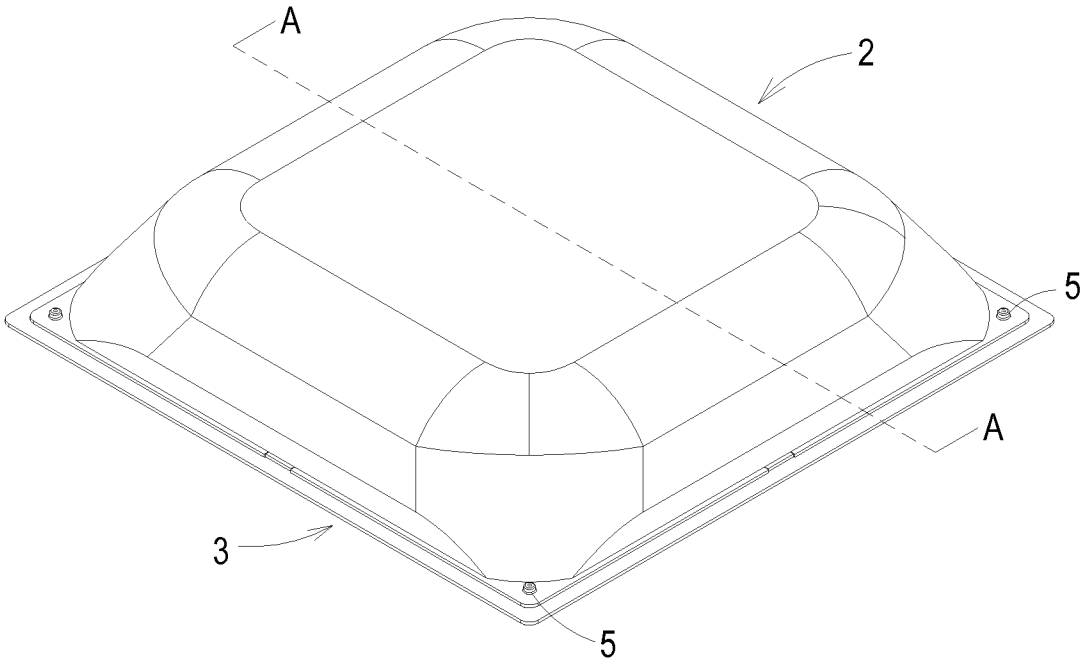
FIG. 2B is a schematic bottom view illustrating the assembled recirculation fan of FIG. 1.

FIG. 2A is a schematic top view illustrating the assembled recirculation fan of FIG. 1. FIG. 2B is a schematic bottom view illustrating the assembled recirculation fan of FIG. 1. Please refer to FIGS. 2A and 2B. After the covering member 3 is combined with the casing 2, an accommodation space 22 is defined to accommodate some components of the recirculation fan 1 and provide a space for operating the fan assembly 4 (see FIG. 1). In other words, since the fan assembly 4 is disposed and operated within the space between the covering member 3 and the casing 2, the air-circulating efficiency is enhanced and the noise is reduced. As a consequence, the recirculation fan 1 can comply with the safety regulations.

In some embodiments, the covering member 3 further comprises a first airflow-guiding structure 31 and a second airflow-guiding structure 32. The first airflow-guiding structure 31 and the second airflow-guiding structure 32 are for example annular structures, sheet structures, meshed structures, hollow structures or rectangular structures. Due to the first airflow-guiding structure 31 and the second airflow-guiding structure 32, the regions to inhale or exhale the airflow will be increased. Moreover, according to the principles of fluid mechanics, the amount of airflow required for operating the fan assembly 4 may be increased or a portion of the airflow generated by the fan assembly 4 may be recycled and re-circulated. Consequently, the overall efficiency of air convection circulation is enhanced, the overall volume and power consumption are reduced, the power-saving efficacy is enhanced, the space utilization is enhanced, and the cost is reduced.

In this embodiment, the casing 2 and the covering member 3 of the recirculation fan 1 are combined together by an adhering means, a screwing means or an engaging means. As shown in FIG. 2B, the recirculation fan 1 further comprises at least one fastening element 5 for connecting the casing 2 with the covering member 3 in order to increase the structural strength and use safety. In addition, the recirculation fan 1 of the present invention is suitably installed in an indoor construction site. For facilitating the user to detach the recirculation fan 1, the fastening element 5 is a screw/nut assembly. After the screw is penetrated through the covering member 3 and the casing 2, the screw is coupled with the nut.

Figure 3A:
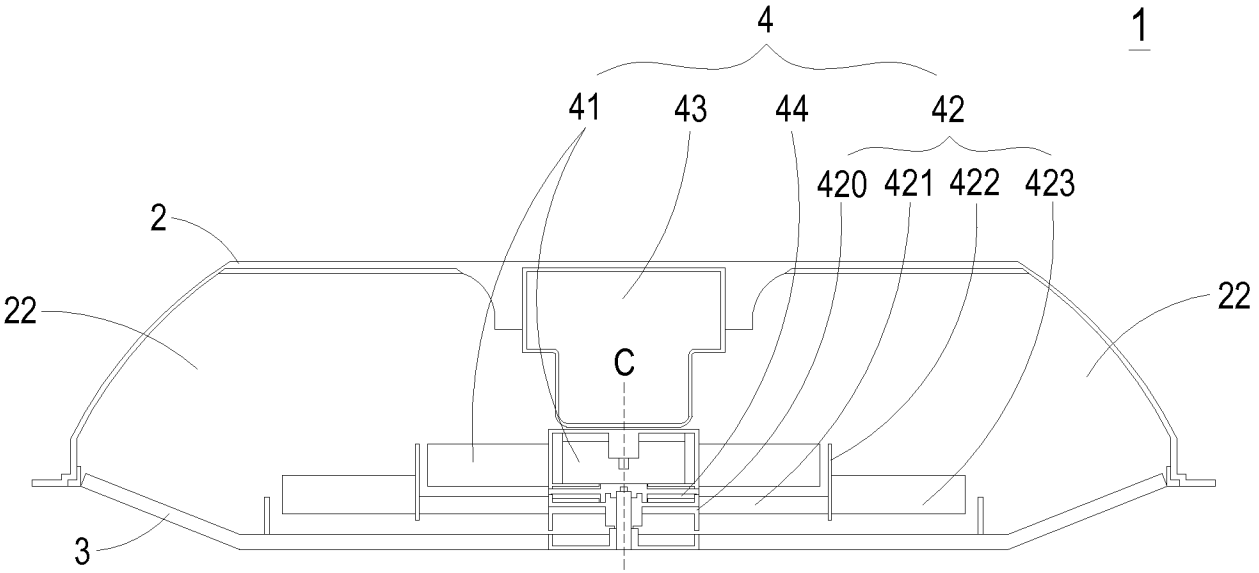
FIG. 3A is a schematic cross-sectional view illustrating the recirculation fan of FIG. 2B and taken along the line A-A.

FIG. 3A is a schematic cross-sectional view illustrating the recirculation fan of FIG. 2B and taken along the line A-A. As shown in FIG. 3A, the fan assembly 4 of the present invention is applied to a recirculation fan 1 with a casing 2 and a covering member 3. The casing 2 has a base 21. After the covering member 3 is combined with the casing 2, an accommodation space 22 is defined to accommodate the fan assembly 4. In addition, the fan assembly 4 comprises a first impeller 41, a second impeller 42, a motor 43, and a plurality of magnetic elements 44. The second impeller 42 is located beside the first impeller 41. The first impeller 41 is connected with the motor 43. The first impeller 41 is driven by the motor 43, so that the first impeller 41 is rotated relative to a center axle line C. The magnetic elements 44 are permanent magnets or magnetic conductors (e.g. iron, cobalt and nickel magnetic conductors). The magnetic elements 44 are disposed on the first impeller 41 and the second impeller 42. Moreover, at least one of the magnetic elements 44 is a permanent magnet, and the other magnetic elements 44 are magnetic conductors or permanent magnets. Due to magnetic change and magnetic induction, a magnetic vortex is generated. The wind force generated by the running first impeller 41 and the magnetic torque resulted from the magnetic vortex of the magnetic elements 44 will cause contactless rotation of the second impeller 42 relative to the center axle line C. The first impeller 41 and the second impeller 42 may be rotated in a clockwise direction or an anti-clockwise direction. However, the first impeller 41 and the second impeller 42 are asynchronously rotated. In other words, although the first impeller 41 and the second impeller 42 are coaxial, the bearings (not shown) of the first impeller 41 and the second impeller 42 are independent components. Consequently, the rotation of the first impeller 41 and the rotation of the second impeller 42 are coaxial but are not synchronous. Due to the independent bearings, the motor 43 only needs to drive the small-size first impeller 41 without the need of directly driving the large-size second impeller 42. Under this circumstance, since a small-size motor 43 is feasible, the volume and power consumption are reduced. Consequently, the power-saving efficacy is achieved, the space layout is simplified, and the fabricating cost is reduced.

Figure 3B:
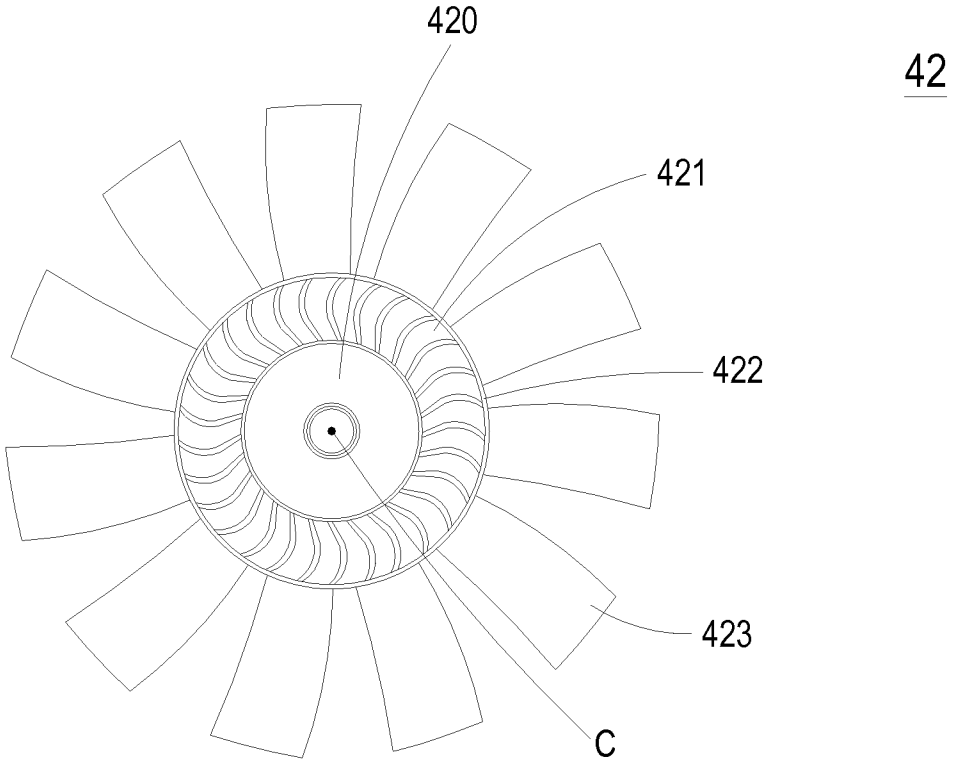
FIG. 3B is a schematic top view illustrating an exemplary second impeller of the recirculation fan of the present invention.

FIG. 3B is a schematic top view illustrating an exemplary second impeller of the recirculation fan of the present invention. Please refer to FIGS. 3B and 3A. In this embodiment, the second impeller 42 of the fan assembly 4 of the recirculation fan 1 comprises a holder 420, a plurality of first blades 421, a ring-shaped structure 422, and a plurality of second blades 423. The first ends of these first blades 421 are disposed on an outer periphery of the holder 420. The second ends of these first blades 421 are connected with the ring-shaped structure 422. That is, the holder 420 is surrounded by the ring-shaped structure 422. The second blades 423 are discretely arranged on and connected with an outer periphery of the ring-shaped structure 422 at regular intervals. In such way, when the first impeller 41 is driven by the motor 43 to generate the wind force, the first blades 421 of the second impeller 42 are pushed by the wind force, so that the first blades 421 are rotated relative to the center axle line C. Since the holder 420 and the ring-shaped structure 422 are connected with the first blades 421 and the second blades 423 are connected with the ring-shaped structure 422, the holder 420 and the ring-shaped structure 422 and the second blades 423 are synchronously rotated with the first blades 421. As a consequence, the whole second impeller 42 is rotated relative to the center axle line C. In some embodiments, the first impeller 41 is at least partially accommodated in the space defined by the ring-shaped structure 422 of the second impeller 42, so that the efficacy of pushing the first blades 421 of the second impeller 42 by the wind force resulted from the first impeller 41 will be increased. Moreover, due to the arrangement of the magnetic elements 44, the rotation of the first impeller 41 and the second impeller 42 may result in magnetic change and magnetic induction and thus generates a magnetic vortex. Consequently, magnetic torque resulted from the magnetic vortex of the magnetic elements 44 will increase the driving force for rotating the second impeller 42 relative to the center axle line C. In other words, the wind force generated by the running first impeller 41 and the magnetic torque resulted from the magnetic vortex of the magnetic elements 44 will cause contactless rotation of the second impeller 42.

Figure 3C:
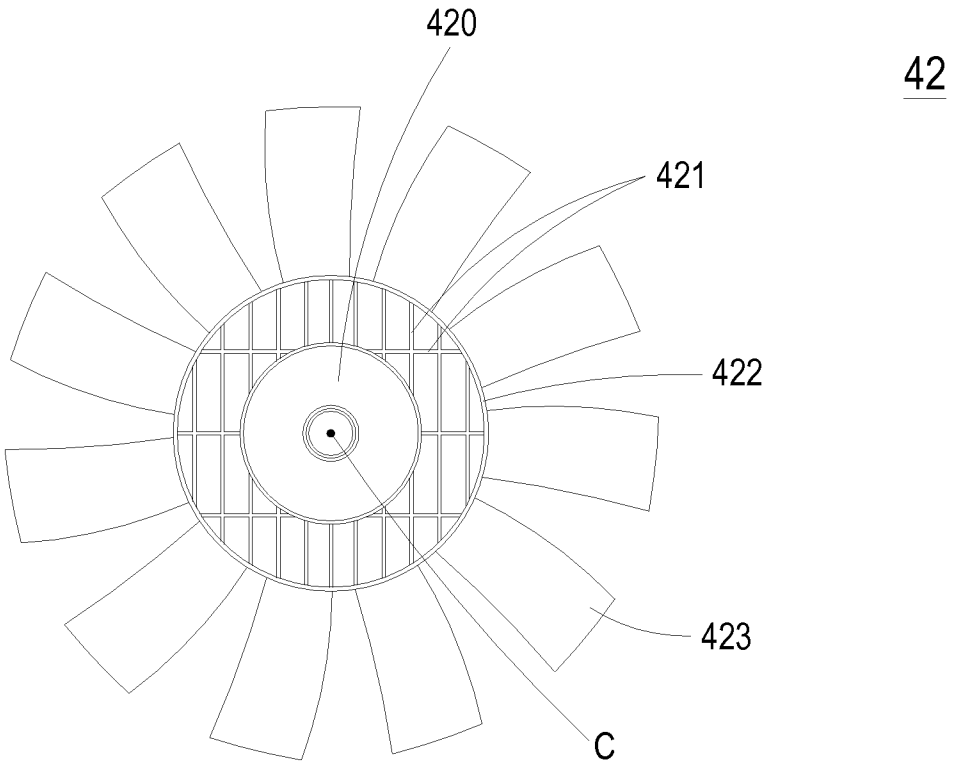
FIG. 3C is a schematic top view illustrating another exemplary second impeller of the recirculation fan of the present invention.

FIG. 3C is a schematic top view illustrating another exemplary second impeller of the recirculation fan of the present invention. Please refer to FIGS. 3C and 3A. In this embodiment, the second impeller 42 of the fan assembly 4 of the recirculation fan 1 comprises a holder 420, a plurality of first blades 421, a ring-shaped structure 422, and a plurality of second blades 423. The configurations of the holder 420, the ring-shaped structure 422 and the second blades 423 are similar to those of FIG. 3B, and are not redundantly described herein. In this embodiment, these first blades 421 have skew angles along the same direction, so that the outlet airflow can be distributed to a larger area. Under this circumstance, the air-circulating efficacy is enhanced. Moreover, since the second impeller 42 is rotated with the first impeller 41, the skew angle of the outlet airflow is also rotated and the outlet airflow can be flowed to a larger area. Moreover, since the second impeller 423 has a certain loading, the rotating speed is not too fast but the circulating efficacy is enhanced.

From the above description, the present invention provides a recirculation fan and a fan assembly of the recirculation fan. Since the recirculation fan is driven by a composite motive force, a small-size impeller and a small-size motor may be employed. Consequently, the overall volume and power consumption of the recirculation fan are reduced, the space layout is simplified, and the cost is reduced. Moreover, the use of the recirculation fan of the present invention can reduce the frequency and time period of using the air conditioner, and further reduce the power consumption of the air conditioner. Since the power consumption of the recirculation fan and the air conditioner is reduced, the power-saving purpose is achieved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A recirculation fan, comprising:
- a casing with a base;
- a covering member coupled with said casing to define an accommodation space; and
- a fan assembly disposed within said accommodation space, and comprising:
  - a first impeller;
  - a second impeller located beside said first impeller;
  - a motor fixed on said base of said casing and connected with said first impeller for driving rotation of said first impeller; and
  - a plurality of magnetic elements arranged between said first impeller and said second impeller,
  - wherein a wind force generated by said first impeller and a magnetic torque resulted from a magnetic vortex of said magnetic elements cause contactless rotation of said second impeller.

2. The recirculation fan according to claim 1, wherein said plurality of magnetic elements are permanent magnets or magnetic conductors.

3. The recirculation fan according to claim 2, wherein at least one of said plurality of magnetic elements is a permanent magnet.

4. The recirculation fan according to claim 1, wherein said covering member further comprises a first airflow-guiding structure and a second airflow-guiding structure for increasing airflow-inhaling and airflow-exhaling regions.

5. The recirculation fan according to claim 4, wherein said airflow-guiding structure and said second airflow-guiding structure are annular structures, sheet structures, meshed structures, hollow structures or rectangular structures.

6. The recirculation fan according to claim 1, wherein said recirculation fan further comprises a plurality of fastening elements, wherein said fastening elements are penetrated through said casing and said covering member, so that said casing and said covering member are combined together.

7. The recirculation fan according to claim 1, wherein said first impeller and said second impeller are rotated relative to a center axle line, and said first impeller and said second impeller are rotated in the same direction.

8. The recirculation fan according to claim 7, wherein said first impeller and said second impeller are coaxial, and said first impeller and said second impeller are asynchronously rotated.

9. The recirculation fan according to claim 1, wherein said second impeller comprises:
- a holder;
- a plurality of first blades, wherein first ends of said first blades are disposed on an outer periphery of said holder;
- a ring-shaped structure, wherein second ends of said first blades are connected with said ring-shaped structure, and said holder is surrounded by said ring-shaped structure; and
- a plurality of second blades connected to an outer periphery of said ring-shaped structure.

10. The recirculation fan according to claim 9, wherein said second blades of said second impeller are discretely arranged on said outer periphery of said ring-shaped structure at regular intervals.

11. The recirculation fan according to claim 9, wherein said first impeller is at least partially accommodated in a space defined by said ring-shaped structure of said second impeller.

12. A fan assembly, comprising:
- a first impeller;
- a second impeller located beside said first impeller;
- a motor connected with said first impeller for driving rotation of said first impeller; and
- a plurality of magnetic elements disposed on said first impeller and said second impeller,
  - wherein a wind force generated by said first impeller and a magnetic torque resulted from a magnetic vortex of said magnetic elements cause contactless rotation of said second impeller.

13. The fan assembly according to claim 12, wherein said plurality of magnetic elements are permanent magnets or magnetic conductors.

14. The fan assembly according to claim 13, wherein at least one of said plurality of magnetic elements is a permanent magnet.

15. The fan assembly according to claim 12, wherein said first impeller and said second impeller are rotated relative to a center axle line, and said first impeller and said second impeller are rotated in the same direction.

16. The fan assembly according to claim 15, wherein said first impeller and said second impeller are coaxial, and said first impeller and said second impeller are asynchronously rotated.

17. The fan assembly according to claim 12, wherein said second impeller comprises:

a holder;

a plurality of first blades, wherein first ends of said first blades are disposed on an outer periphery of said holder;

a ring-shaped structure, wherein second ends of said first blades are connected with said ring-shaped structure, and said holder is surrounded by said ring-shaped structure; and a plurality of second blades connected to an outer periphery of said ring-shaped structure.

18. The fan assembly according to claim 17, wherein said second blades of said second impeller are discretely arranged on said outer periphery of said ring-shaped structure at regular intervals.

19. The fan assembly according to claim 17, wherein said first impeller is at least partially accommodated in a space defined by said ring-shaped structure of said second impeller.

* * * * *